US007248140B2

(12) United States Patent
Yu

(10) Patent No.: US 7,248,140 B2
(45) Date of Patent: Jul. 24, 2007

(54) ADJUSTABLE SAFETY SWITCH

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 383 days.

(21) Appl. No.: 11/073,170

(22) Filed: Mar. 5, 2005

(65) Prior Publication Data

US 2006/0197645 A1 Sep. 7, 2006

(51) Int. Cl.
*H01H 37/70* (2006.01)
*H01H 37/52* (2006.01)
*H01H 37/18* (2006.01)

(52) U.S. Cl. ..... 337/94; 337/56; 337/72; 337/66

(58) Field of Classification Search ..... 337/56, 337/72, 66, 94; 200/339, 341
See application file for complete search history.

(56) References Cited

U.S. PATENT DOCUMENTS 3,932,829 A * 1/1976 Ellenberger ..... 337/49
4,258,349 A * 3/1981 Flory ..... 337/46
4,329,669 A * 5/1982 Krasser et al. ..... 335/20
4,338,586 A * 7/1982 Scanlon ..... 337/74
4,345,233 A * 8/1982 Matthies ..... 337/75
4,528,538 A * 7/1985 Andersen ..... 337/43
4,833,439 A * 5/1989 Bowden et al. ..... 337/68
4,922,219 A * 5/1990 Bakhaus et al. ..... 337/74
5,089,799 A * 2/1992 Sorenson ..... 337/68
5,223,813 A * 6/1993 Cambreleng et al. ..... 337/66
5,262,748 A * 11/1993 Tsung-Mou ..... 337/66
5,264,817 A * 11/1993 Sorenson ..... 337/68
5,491,460 A * 2/1996 Krasser et al. ..... 337/70
5,539,371 A * 7/1996 Yu ..... 337/66
5,760,672 A * 6/1998 Wang ..... 337/79
5,892,426 A * 4/1999 Huang ..... 337/59
6,275,134 B1 * 8/2001 Chen ..... 337/37
6,307,460 B1 * 10/2001 Yu ..... 337/37
6,400,250 B1 * 6/2002 Wang ..... 337/66

(Continued)

FOREIGN PATENT DOCUMENTS

FR 2605142 A1 * 4/1988

*Primary Examiner*—Anatoly Vortman

(57) ABSTRACT

A switch device includes a body with switch pivotably connected to a top thereof and two terminals extend through an underside of the body. A first contact point is connected to one of the terminals and a bi-metallic plate has a first end fixed to the other terminal. A second contact point is connected to an underside of a second end of the bi-metallic plate and located above the first contact point. A pull member has an upper end pivotably connected to the switch member and a lower end of the pull member supports the underside of the second end of the bi-metallic plate. An upper end of a push member is pivotably connected to the switch member and a lower end of the push member is in contact with the bi-metallic plate. A spring is biased between the push member and the body so as to provide a push force to the push member. A board movably received in a recess in an inside of the body and movable by an adjusting member extending through a hole through the body. A biasing member has a first end connected to the second end of the bi-metallic plate and a second end of the biasing member is engaged with the board. The biasing force of the biasing member relative to the bi-metallic plate is adjusted by moving the adjusting member.

10 Claims, 4 Drawing Sheets

(OFF)

U.S. PATENT DOCUMENTS 6,445,273 B1 * 9/2002 Yu ..... 337/37
6,456,185 B1 * 9/2002 Yu ..... 337/37
6,512,441 B1 * 1/2003 Yu ..... 337/37
6,525,639 B1 * 2/2003 Cheng ..... 337/37
6,552,644 B2 * 4/2003 Yu ..... 337/66
6,563,414 B2 * 5/2003 Yu ..... 337/66
6,577,221 B1 * 6/2003 Wang ..... 337/59
6,617,952 B1 * 9/2003 Yu ..... 337/94
6,621,402 B2 * 9/2003 Huang ..... 337/66
6,664,884 B1 * 12/2003 Yu ..... 337/59
6,674,033 B1 * 1/2004 Wang ..... 200/334
6,714,116 B1 * 3/2004 Sang et al. ..... 337/68
6,734,779 B2 * 5/2004 Yu ..... 337/59
6,788,186 B1 * 9/2004 Yu ..... 337/66
6,864,453 B1 * 3/2005 Yu ..... 200/520
6,940,389 B1 * 9/2005 Yu ..... 337/66
7,030,726 B2 * 4/2006 Yu ..... 337/66
2003/0160679 A1 * 8/2003 Yu ..... 337/37
2005/0140489 A1 * 6/2005 Kuo ..... 337/66

* cited by examiner (OFF)

(ON)

ADJUSTABLE SAFETY SWITCH

FIELD OF THE INVENTION

The present invention relates to a safety switch including a adjusting assembly to adjustably keep proper flexibility of the bi-metallic plate to ensure that the bi-metallic plate is deformed as desired under overload conditions.

BACKGROUND OF THE INVENTION

A conventional switch device, especially for those switches using bi-metallic plate to prevent from being burn when an overload is happened, generally includes a bi-metallic plate which is deformed under overload conditions so as to separate the two contact points respectively located on the bi-metallic plate and one of the two terminals. Some inherent shortcomings for these conventional safety switch devices are found. There are too many parts involved in the safety switch device and a longer period of time is required when assembling the switch device, this increases the cost of the products. The parts might be arranged inaccurately and affects the deformation of the bi-metallic plate. Once the bi-metallic plate is deformed to cut off the circuit, because of the improper arrangement of the parts as mentioned above, the bi-metallic plate could deform to re-connect the two contact points to connect the circuit again. Because the inaccuracy of the deformation of the bi-metallic plate, the switch member does not set the "OFF" position after the bi-metallic plate is deformed to cut off the circuit.

Therefore, it is desired to have a device to ensure that the bi-metallic plate has proper flexibility and is deformed to accurately separate the two contact points and to pivot the switch member to "OFF" position.

SUMMARY OF THE INVENTION

In accordance with an aspect of the present invention, there is provided a switch device that comprises a body with a top opening for a switch member pivotably engaged therewith and two slots defined through an underside of the body so that a first terminal and a second terminal extend through the two slots. A first contact point is connected to the second terminal. A bi-metallic plate has an end fixed to the first terminal and a second contact point is connected to an underside of a second end of the bi-metallic plate. The second contact point is located above the first contact point. A recess is defined in an inside of the body and a hole is defined through a wall of the body and communicates with the recess. A link assembly includes a pull member and a push member, wherein an upper end of the pull member is pivotably connected to the switch member and a lower end of the pull member supports the underside of the second end of the bimetallic plate. An upper end of the push member is pivotably connected to the switch member and a lower end of the push member is in contact with the bi-metallic plate. A spring is biased between the push member and the body so as to provide a push force to the push member. An adjusting assembly which includes a board movably received in the recess and an adjusting member movably extends through the hole and is in contact with a first side of the board. A biasing member has a first end connected to the second end of the bi-metallic plate and a second end of the biasing member is engaged with a second side of the board.

The main object of the present invention is to provide a safety switch that uses a link assembly connected with the switch member to effectively control the bi-metallic plate to move between "ON" and "OFF" positions.

Another object of the present invention is to provide an adjusting assembly to connect a biasing member to a free end of the bi-metallic plate. The connection angle and force between the biasing member and the bi-metallic plate can be adjusted to ensure that the bi-metallic plate is deformed as desired under overload conditions.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
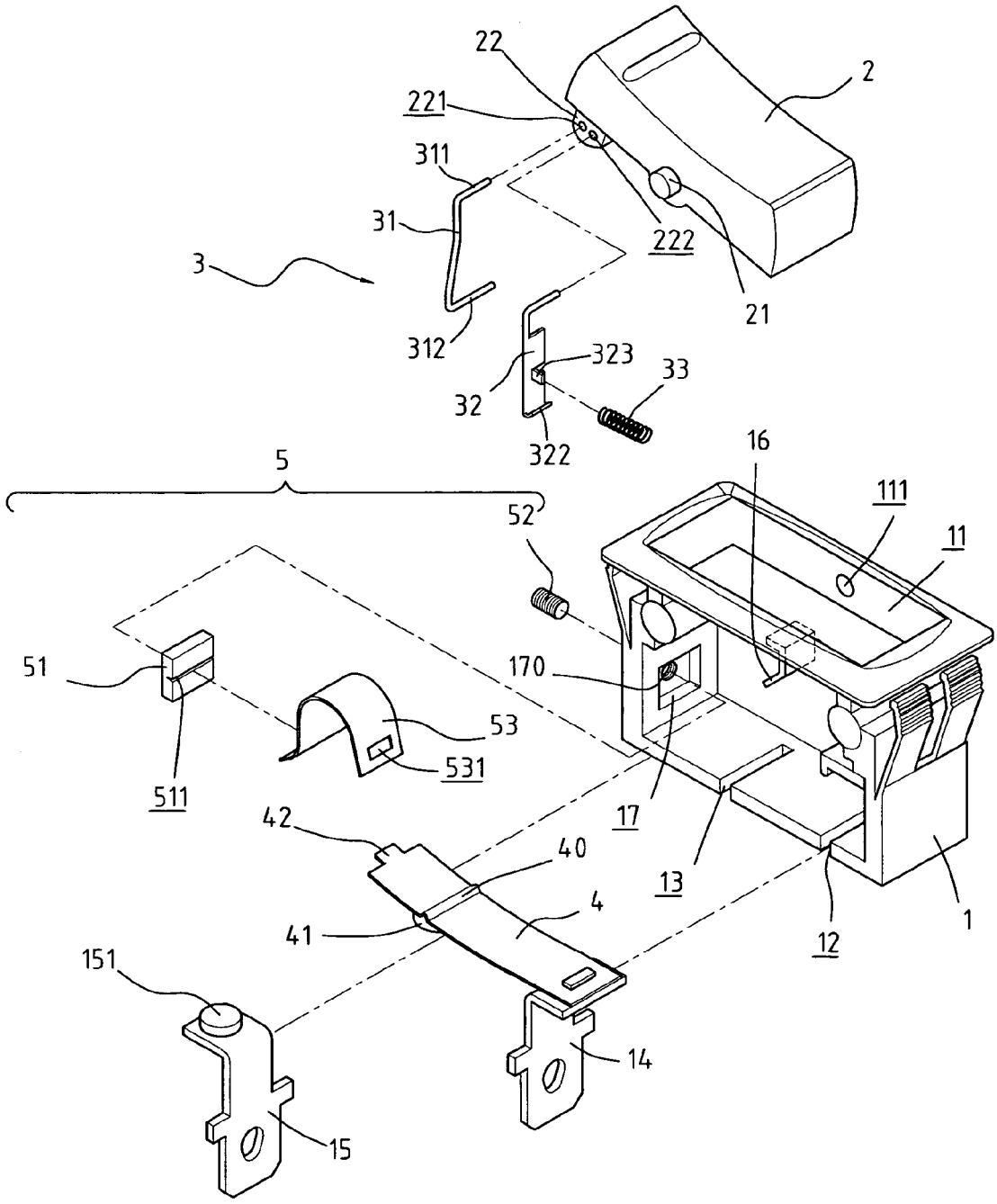
FIG. 1 is an exploded view of a safety switch device in accordance with the present invention.
Figure 2:
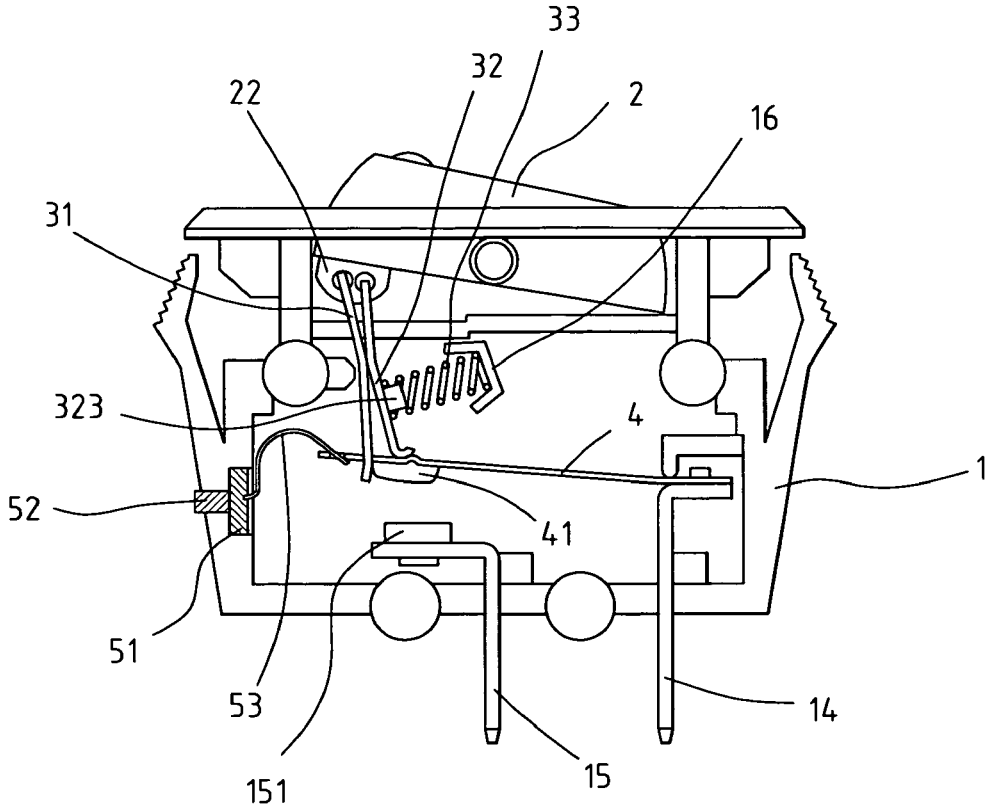
FIG. 2 shows a bi-metallic plate of the safety switch in accordance with the present invention in "OFF" position.

Referring to the drawings and in particular FIGS. 1 and 2, a safety switch device comprises a body 1 with a top opening 11 and two pivot holes 111 are defined through two opposite walls of the body 1. A switch member 2 is pivotably engaged with the top opening 11 of the body 1 by pivotally engaging two pivots 21 extending from two sides of the switch member 2 with the two pivot holes 111. A protrusion 22 extends from an underside of an end of the switch member 2 and includes two receiving holes 221, 222. Two slots 12, 13 are defined through an underside of the body 1 so that a first terminal 14 and a second terminal 15 extend through the two slots 12, 13. A first contact point 151 is connected to the second terminal 15 and a bi-metallic plate 4 has a first end fixed to a top of the first terminal 14 and a second contact point 41 connected to an underside of a second end of the bi-metallic plate 4. The second contact point 41 is located above the first contact point 151. A recess 17 is defined in an inside of the body 1 and a hole 170 is defined through a wall of the body 1 and communicates with the recess 17.

A link assembly 3 includes a pull member 31 and a push member 32. A first link 311 extends from an upper end of the pull member 13 and is pivotably engaged with the receiving hole 221 in the switch member 2 and a second link 312 extends from the lower end of the pull member 31. The second end of the bi-metallic plate 4 is supported on the second link 312. A third link extends from the upper end of the push member 32 and is pivotably engaged with the receiving hole 322, a bending portion 322 is formed on the lower end of the push member 32 and in contact with a top surface of the bi-metallic plate 4. The bi-metallic plate 4 includes a ridge 40 extending from the top thereof and the bending portion 322 of the push member 32 is in contact with one of two sides of the ridge 40. A boss 323 extends from a side of the push member 32 and one end of a spring 33 is mounted to the boss 323 and the other end of the spring 33 is engaged with an extension 16 of the body 1. The spring 33 can be a spiral spring which provides a push force to the push member 32 toward the pull member 31.

An adjusting assembly 5 includes a board 51 movably received in the recess 17 and an adjusting member 52 such as a bolt movably extends through the hole 170 and is in contact with a first side of the board 51. A biasing member 53 which is a U-shaped plate has a through hole 531 defined through a first end thereof and the second end of the bi-metallic plate 4 includes a tongue 42 which is engaged with the through hole 531. A second end of the biasing member 53 is engaged with a notch 511 defined in a second side of the board 51. The board 51 is moved axially in the recess 17 by operating the adjusting member 52 and a biasing force of the biasing member 53 relative to the bi-metallic plate 4 is adjusted.

Figure 3:
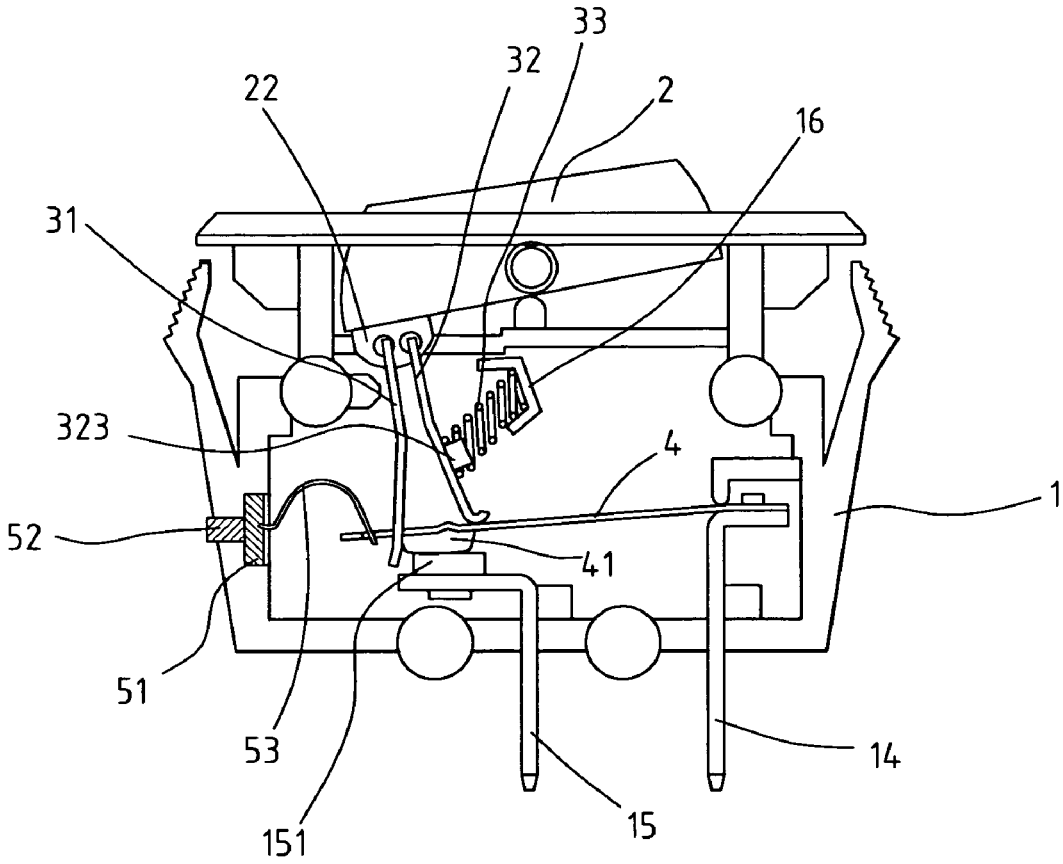
FIG. 3 shows the bi-metallic plate in "ON" position.

As shown in FIG. 3, when the switch device is in "ON" position, the left end of the switch member 2 is pushed and the bending portion 322 of the push member 32 pushes the second end of the bi-metallic plate 4 downward, the bending portion 322 moves over the ridge 40 from the left side of the ridge 40 to the right side of the ridge 40. The first and second contact points 41, 151 are in contact with each other so that circuit is in "ON" status. When the switch device is in "ON" position and the current is overload, the bi-metallic plate 4 is deformed upward and the first and second contact points 41, 151 are separated so that the circuit is cut off. The biasing member 53 ensures that the bi-metallic plate 4 has sufficient force to be deformed as desired.

Figure 4:
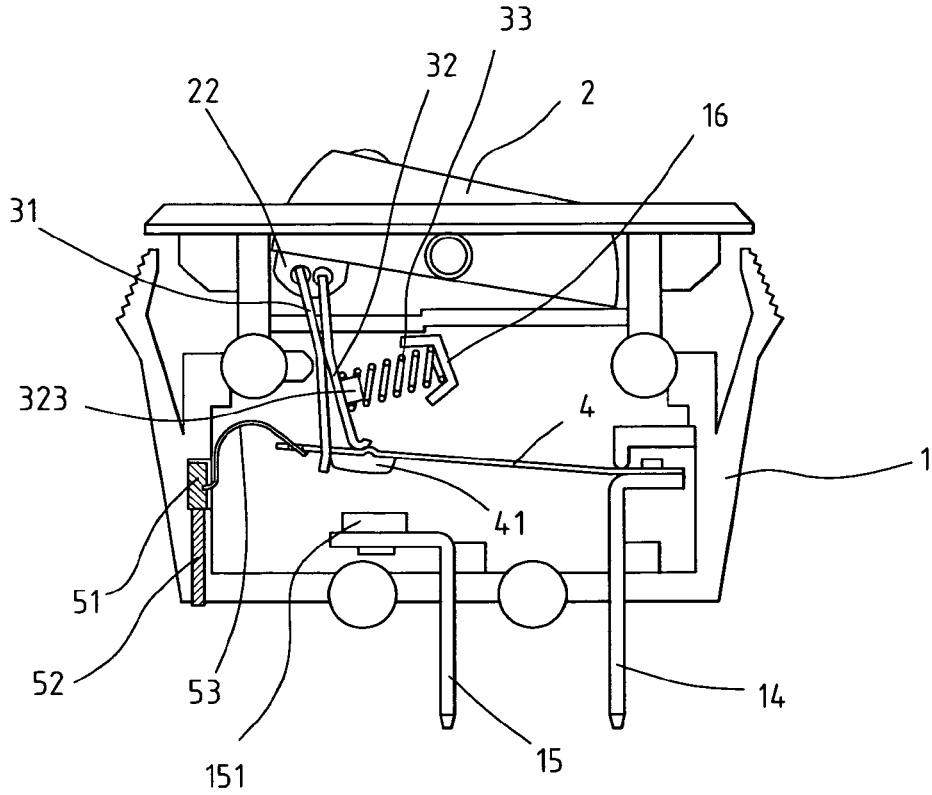
FIG. 4 shows another embodiment of the switch device of the present invention.

As shown in FIG. 4, the adjusting assembly 5 can be made by another arrangement, wherein a passage is defined in the underside of the body 1 and communicates with the recess 17. A width of the board 51 is smaller than a width of the recess 17 so that the board 51 is movable in the recess 17. The board 51 is controlled by the adjusting member 52 and the biasing member 53 is in contact with the board 51.

While we have shown and described the embodiment in accordance with the present invention, it should be clear to those skilled in the art that further embodiments may be made without departing from the scope of the present invention.

What is claimed is:

1. A switch device comprising:

a body with a top opening and two slots defined through an underside of the body, a first terminal and a second terminal extending through the two slots and a first contact point connected to the second terminal, a recess defined in an inside of the body and a hole defined through a wall of the body and communicating with the recess;

a bi-metallic plate having a first end fixed to the first terminal and a second contact point connected to an underside of a second end of the bi-metallic plate, the second contact point located above the first contact point;

a switch member pivotably engaged with the top opening of the body;

a link assembly including a pull member and a push member, an upper end of the pull member pivotably connected to the switch member and a lower end of the pull member supporting the underside of the second end of the bi-metallic plate, an upper end of the push member pivotably connected to the switch member and a lower end of the push member being in contact with the bi-metallic plate, a spring biased between the push member and the body so as to provide a push force to the push member, and an adjusting assembly including a board movably received in the recess and an adjusting member movably extending through the hole and being in contact with a first side of the board, a biasing member having a first end connected to the second end of the bi-metallic plate and a second end of the biasing member being engaged with a second side of the board, the board being moved axially in the recess by operating the adjusting member and a biasing force of the biasing member relative to the bi-metallic plate is adjusted.

2. The device as claimed in claim 1, wherein a protrusion extends from an underside of an end of the switch member and includes two receiving holes, a first link extends from the upper end of the pull member and is pivotably engaged with one of the receiving holes, a second link extends from the lower end of the pull member and the second end of the bi-metallic plate is supported on the second link, a third link extends from the upper end of the push member and is pivotably engaged with the other receiving holes, a bending portion is formed on the lower end of the push member and in contact with a top surface of the bi-metallic plate, a boss extends from a side of the push member and one end of the spring is mounted to the boss and the other end of the spring is engaged with an extension of the body.

3. The device as claimed in claim 1, wherein the spring is a spiral spring.

4. The device as claimed in claim 2, wherein the bi-metallic plate includes a ridge extending from the top thereof and the bending portion of the push member is in contact with one of two sides of the ridge.

5. The device as claimed in claim 1, wherein two pivot holes are defined through two opposite walls of the body and two pivots extend from two sides of the switch member, the two pivots are pivotably engaged with the two pivot holes.

6. The device as claimed in claim 1, wherein the adjusting member is a bolt.

7. The device as claimed in claim 1, wherein the second side of the board includes a notch and the second end of the biasing member is engaged with the notch.

8. The device as claimed in claim 1, wherein the biasing member is a U-shaped plate.

9. The device as claimed in claim 1, wherein the first end of the biasing member includes a through hole and the second end of the bi-metallic plate includes a tongue which is engaged with the through hole.

10. The device as claimed in claim 1, wherein a passage is defined in the underside of the body and communicates with the recess, a width of the board is smaller than a width of the recess so that the board is movable in the recess, the board is controlled by the adjusting member and the biasing member is in contact with the board.

* * * * *